US005819754A

United States Patent [19]

Conrad et al.

[11] Patent Number: 5,819,754

[45] Date of Patent: Oct. 13, 1998

[54] TOBACCO EXPANSION PROCESSES AND APPARATUS

[75] Inventors: Lucas Jones Conrad; Hoyt Sturdivant Beard; Franklin Allan Strump, Jr., all of Winston-Salem, N.C.

[73] Assignee: R. J. Reynolds Tobacco Company, Winston-Salem, N.C.

[21] Appl. No.: 581,350

[22] Filed: Dec. 29, 1995

[51] Int. Cl.[6] ..... A24B 3/18

[52] U.S. Cl. ..... 131/291; 131/300; 222/14

[58] Field of Search ..... 131/290, 291, 131/296, 297, 298, 300, 302, 303, 304, 900–902; 222/630, 249, 250, 14

[56] References Cited

U.S. PATENT DOCUMENTS

| | | | |
|---|---|---|---|
| 3,524,452 | 8/1970 | Moser . | |
| 3,683,937 | 8/1972 | Fredrickson et al. . | |
| 3,756,456 | 9/1973 | Georgi | 222/14 X |
| 4,032,041 | 6/1977 | Bruce | 222/14 |
| 4,165,012 | 8/1979 | Markwood . | |
| 4,191,309 | 3/1980 | Alley et al. | 222/14 X |
| 4,235,250 | 11/1980 | Utsch . | |
| 4,258,729 | 3/1981 | de la Burde et al. . | |
| 4,289,148 | 9/1981 | Ziehn . | |
| 4,336,814 | 6/1982 | Sykes et al. . | |
| 4,340,073 | 7/1982 | de la Burde et al. | 131/291 |
| 4,388,932 | 6/1983 | Merritt et al. . | |
| 4,461,310 | 7/1984 | Ziehn . | |
| 4,531,529 | 7/1985 | White et al. . | |
| 4,554,932 | 11/1985 | Conrad et al. . | |
| 4,962,773 | 10/1990 | White et al. . | |
| 5,012,826 | 5/1991 | Kramer . | |
| 5,020,550 | 6/1991 | Uchiyama et al. | 131/291 X |
| 5,031,644 | 7/1991 | Kramer . | |
| 5,076,293 | 12/1991 | Kramer . | |
| 5,095,923 | 3/1992 | Kramer . | |
| 5,143,096 | 9/1992 | Steinberg | 131/291 |
| 5,365,950 | 11/1994 | Yoshimoto et al. | 131/291 |
| 5,469,872 | 11/1995 | Beard et al. | 131/291 |
| 5,483,977 | 1/1996 | Conrad et al. . | |

*Primary Examiner*—Jennifer Bahr

[57] ABSTRACT

An apparatus for impregnating tobacco with an expansion agent includes a chamber for confining a charge of tobacco under elevated pressure conditions. An accumulator connected to the chamber maintains a supply of an expansion agent in fluid form under conditions of elevated temperature and pressure but less than the desired tobacco impregnation temperature and pressure. The expansion agent is forcibly and rapidly moved from the accumulator and introduced into the chamber under conditions such that the pressure and temperature of the expansion agent are increased to the desired impregnation temperature and pressure, preferably including a pressure approaching or above the supercritical pressure thereof.

23 Claims, 4 Drawing Sheets

TOBACCO EXPANSION PROCESSES AND APPARATUS

FIELD OF THE INVENTION

The invention relates to processes and apparatus for expanding tobacco by impregnating the tobacco with an expansion agent under conditions of elevated pressure and temperature and thereafter exposing the tobacco to conditions promoting expansion of the expansion agent. More particularly, the invention relates to processes and apparatus for expanding tobacco improving the supply of heat and pressurized expansion agent to the impregnation zone.

BACKGROUND OF THE INVENTION

Tobacco expansion processes are used to restore tobacco bulk, density, and/or volume which are lost during curing and storing tobacco leaf. In recent years, expanded tobacco has become an important component of many reduced tar cigarettes, including low tar and ultra-low tar cigarettes.

Processes in which tobacco is contacted with an expansion agent and rapidly heated to volatilize the expansion agent and expand the tobacco are described, for example in U.S. Pat. No. 3,524,451 to Fredrickson et al. and U.S. Pat. No. 3,524,452 to Moser, et al. A process employing a vapor state impregnation of tobacco followed either by heating or rapid pressure reduction for tobacco expansion is disclosed by U.S. Pat. No. 3,683,937 to Fredrickson et al.

The use of carbon dioxide as an expansion agent for expanding tobacco is disclosed in U.S. Pat. No. 4,235,250 to Utsch; U.S. Pat. No. 4,258,729 to Burde et al.; and U.S. Pat. No. 4,336,814 to Sykes et al., among others. In these and related processes, carbon dioxide, either in gas or liquid form is contacted with tobacco for impregnation and thereafter the impregnated tobacco is subjected to rapid heating conditions to volatilize the carbon dioxide and thereby expand the tobacco.

U.S. Pat. No. 4,461,310 to Zeihn and U.S. Pat. No. 4,289,148 to Zeihn describe the expansion of to tobacco using supercritical nitrogen or argon impregnation of tobacco. These expansion agents are removed from the tobacco during a rapid pressure reduction, and the tobacco is expanded by exposure to heated gas or microwave. These processes require treatment of tobacco at pressures in excess of 2000 or 4000 psi up to above 10,000 psi to achieve substantial tobacco expansion.

U.S. Pat. 4,531,529 to White and Conrad describes a process for increasing the filling capacity of tobacco, wherein the tobacco is impregnated with a low-boiling and highly volatile expansion agent, such as a normally gaseous halocarbon or hydrocarbon at process conditions above or near the critical pressure and temperature of the expansion agent. The pressure is quickly released to the atmosphere so that the tobacco expands without the necessity of the heating step to either expand the tobacco or fix the tobacco in the expanded condition. The pressure conditions of this process range from 36 kilograms per square centimeter (512 psi) and higher with no known upper limit.

U.S. Pat. No. 4,554,932 to Conrad and White describes a fluid pressure treating apparatus, including a cylindrical shell and a reciprocating spool assembly mounted for movement between a loading position outside the shell and a treating position within the shell. Sealing members on the spool assembly are provided for engaging the shell to form a pressure chamber. Conduits are provided to introduce processing fluids into the pressure chamber. This system provided an apparatus for use in high pressure materials treatment, such as tobacco impregnation for expansion, permitting easy loading and unloading and minimizing the time associated with sealing and locking steps normally used in high pressure treatment apparatus.

U.S. Pat. No. 5,067,293 to Kramer is directed to a process and apparatus for treatment of tobacco material and other biological materials having a mechanism for forming a dynamic seal in which cooperating moving surfaces seal a treatment chamber. The dynamic seal system provided according to this patent is useful in treating tobacco at elevated temperature and pressure conditions, including conditions of supercritical temperature and pressure for processes including tobacco expansion. Both continual and batch processes are disclosed.

Tobacco expansion processes, including those described above and others, typically must be conducted in batch processes when impregnation pressures substantially above atmospheric pressure are used. However, the batch treating processes can require increased cycle times due in part to the time required in introducing and removing high pressure impregnating agents from the vessels. In order to reduce cycle time, it is necessary to have a generally continuous supply of the impregnating agent at the appropriate high pressure and heated to an appropriate high temperature.

The maintenance of a substantial supply of highly pressurized expansion agent at an appropriately increased temperature requires costly apparatus, and process control. In addition, some highly effective tobacco expansion processes use flammable expansion agents such as ethane or propane at high pressure and high temperature conditions. In order to minimize hazards associated with these materials it is desirable to minimize the quantity of expansion agent stored under high temperature/high pressure conditions.

SUMMARY OF THE INVENTION

This invention provides tobacco expansion processes and apparatus that can be employed for expanding tobacco at rapid throughput rates employing high pressure and elevated temperature tobacco impregnation conditions while minimizing stored quantities of high temperature/high pressure expansion agent. Moreover, the process and apparatus of the invention can improve the efficiency of energy usage for compressing and heating the expansion agent. The processes and apparatus of the invention are nevertheless capable of rapidly supplying substantial quantities of heated, high pressure expansion agent to a tobacco expansion process and are particularly useful in processes and apparatus of U.S. patent application Ser. No. 08/076,535, filed Jun. 14, 1993, by Lucas J. Conrad and Jackie L. White, now U.S. Pat. No. 5,483,977, which can dramatically improve high pressure tobacco impregnation and expansion throughputs. Those processes preferably involve tobacco impregnation and expansion cycle times of less than 20–30 seconds; the use of high temperature, high pressure propane, e.g., above 2000 psig and 200° F., as the expansion agent; preheating of tobacco batches; and/or compression of tobacco within a high pressure impregnation zone.

The tobacco expansion processes and apparatus of the present invention supply a compressible tobacco expansion agent to a tobacco batch impregnation chamber from a positive displacement accumulator containing expansion agent at a first temperature and pressure. Preferably the accumulator contains propane at a temperature above about 100° F. and a pressure above about 500 psig. The accumulator includes a piston which rapidly and forcibly discharges a predetermined volume of the expansion agent, measured at the first pressure and temperature, via a fluid supply line into the impregnation chamber containing the batch of tobacco. In accordance with the invention, the predetermined volume of the expansion agent is greater than the volume of the tobacco impregnation chamber. As the expansion agent is forcibly compressed into the smaller volume of the impregnation chamber, the pressure and temperature of expansion agent are increased above the first pressure and temperature to the desired pressure and temperature for achieving the desired high temperature conditions for impregnating the tobacco batch. Preferably, the supply line and the impregnation chamber are constructed to have a combined volume less than the volume of the accumulator.

Accordingly, the temperature and pressure of the expansion agent used in the present invention can be maintained below the desired tobacco impregnation temperature and pressure until the higher temperature and pressure are needed for impregnating the tobacco. Moreover, the expansion agent can be heated more rapidly by the internally generated heat of compression than by relying on external heating sources so that the overall cycle time for tobacco impregnation can be minimized. The heat generated during compression of the expansion agent can also efficiently supply heat to the tobacco. Nevertheless, the process and apparatus of the invention allow use of smaller, less costly, high pressure vessels and can decrease hazards associated with high pressure vessels and storage of high pressure flammable fluids. Various apparatus can be employed in conducting the processes of the invention.

In preferred embodiments, a spool-type tobacco expansion apparatus of the type disclosed in U.S. Pat. No. 4,554,932 to Conrad and White is used. Preferably the tobacco expansion agent, e.g., propane fluid, is used at elevated temperature and pressures near or above its critical pressure, to impregnate tobacco for subsequent expansion without heating. A preferred expansion agent accumulator of the invention includes a positive displacement piston for forcibly discharging expansion agent from the accumulator. Advantageously, the accumulator is provided in the form of a cylindrical vessel having a positive displacement piston mounted for movement within its interior. As the piston is moved in a direction toward a port at one end of the vessel, it compresses the expansion agent while simultaneously discharging the expansion agent into the smaller volume of the impregnation chamber and supply line thereto. Preferably the piston displaces substantially all of the expansion agent out of the accumulator in a single stroke. Advantageously the cylindrical accumulator vessel has a volume at least about 50% greater than the combined volume of the supply line and the impregnation chamber.

Preferably, at least a portion of expansion fluid is recovered from the tobacco impregnation chamber and recycled back to the accumulator for use in subsequent impregnation cycles. Advantageously, following impregnation of the tobacco, the expansion agent is released from the impregnation zone under pressure, into the fluid supply line connecting the impregnation zone and the accumulator. The high pressure, high temperature expansion agent recycled from the impregnation zone is then collected in the accumulator. The amount of expansion agent redirected back to the accumulator will be less than the total amount of expansion agent originally charged to the impregnation zone. Thus the pressure of the expansion agent within accumulator will normally be less than the pressure of the original charge. Additional virgin or recovered propane can be introduced into the accumulator to provide the desired amount of expansion agent under elevated pressure and temperature conditions for operation of the next tobacco impregnation cycle.

BRIEF DESCRIPTION OF THE DRAWINGS

In the drawings which form a portion of the original disclosure of the invention.

DETAILED DESCRIPTION OF THE PREFERRED EMBODIMENT

Figure 1:
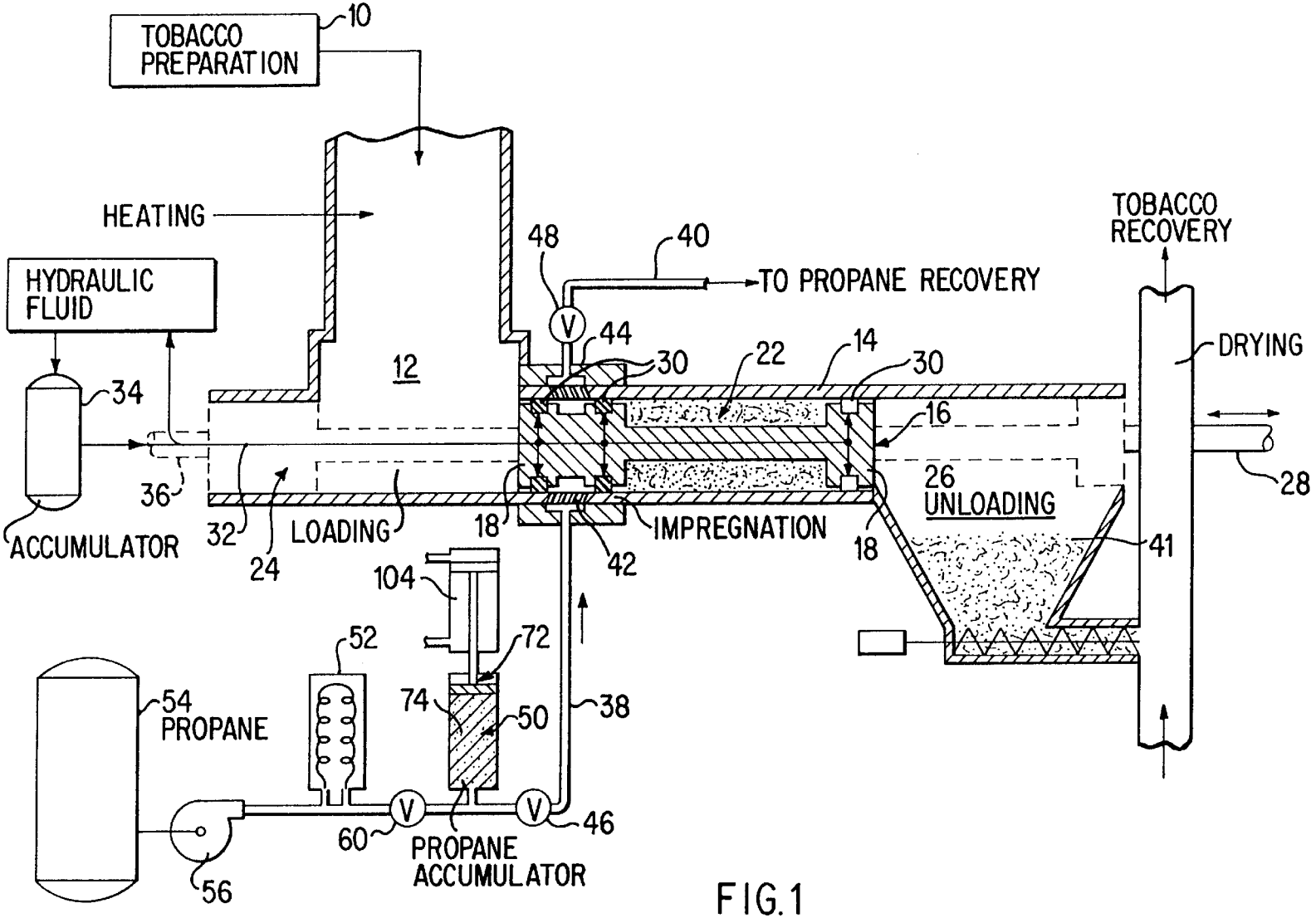
FIG. 1 is a schematic cross-sectional view of one preferred tobacco impregnation apparatus employed in the invention with various different operating positions being partially illustrated in phantom.

Different process and apparatus embodiments of the invention are set forth below. While the invention is described with reference to specific processes and apparatus, including those illustrated in the drawings, it will be understood that the invention is not intended to be so limited. To the contrary, the invention includes numerous alternatives, modifications and equivalents as will become apparent from a consideration of the forthcoming discussion and the following detailed description.

FIG. 1 schematically illustrates a preferred impregnation process and apparatus of the invention, including a spool and a shell apparatus generally constructed in accordance with U.S. Pat. No. 4,554,932, issued Nov. 26, 1985, to Conrad and White; and pending U.S. patent application Ser. No. 08/076,535 of Conrad and White, filed Jun. 14, 1993, and pending U.S. patent application Ser. No. 08/163,048 of Beard et al., filed Dec. 6, 1993, the entire disclosures of which are hereby incorporated by reference. Various details disclosed in the '932 patent and the aforesaid U.S. Patent Applications are not repeated here for the sake of brevity. However, reference may be made to the '932 patent and such Applications for such details.

As illustrated schematically in FIG. 1, tobacco is preferably first treated in a preparation zone 10 to increase its moisture content to a value above about 16% by weight, preferably above about 20% by weight. The tobacco of increased moisture content is then passed to a feeding zone 12 wherein the tobacco can be heated, for example, using steam heat, and is then fed to a high pressure impregnation zone, preferably in the form of a reciprocating spool and shell high pressure fluid treating apparatus.

The spool and shell high pressure fluid treating apparatus includes a pressure vessel defined by a cylindrical shell or enclosure 14 and a spool assembly 16. The shell 14 and spool assembly 16 can be made of any suitable materials, including stainless steel and the like. The specific construction and size of the shell and spool will be sufficient to withstand the pressures contemplated within the pressure vessel as will be apparent.

The spool assembly 16 includes cylindrically shaped end members 18 and a connecting rod 20. When the spool 16 is within the shell 14 as illustrated in FIG. 1, the end of members 18, together with the connecting rod 20 and the shell 14 define an annular space 22 of predetermined volume constituting a sealed pressure chamber or zone. The spool assembly 16 is advantageously arranged for reciprocating movement among a loading position 24, illustrated in phantom; and unloading position 26, also illustrated in phantom; and an impregnating position specifically shown in FIG. 1. A fast acting hydraulic piston or similar motor means (not shown) is axially attached via a shaft 28 partially shown in FIG. 1 for moving the spool among the three positions.

The spool is loaded with tobacco at position 24, for example as described in the above-referenced pending applications, and is then moved to the impregnating position. The tobacco can be in any of various forms including the form of leaf (including stem and veins), strips (leaf with the stem removed), or cigar or cigarette cut filler (strips cut or shredded for cigarette or cigar making).

Preferably, separate charges of tobacco are forced onto the spool assembly 16 to compress the tobacco to a density of from about 125% to about 300% or greater, of the loose fill density of the same tobacco (normalized to the same moisture). Packing densities of 25–30 pounds per cubic foot, calculated based on a moisture content of 12 wt. % can readily be employed as discussed in the above-referenced pending applications. Means can be provided which press the tobacco onto the spool assembly 16, thereby substantially filling the annular space between the end members 18 and surrounding the connecting rod 20. The amount of tobacco is preferably an amount such that its volume when measured in loose form, prior to loading onto the spool assembly 16 is substantially greater than the volume of this annular space.

Following loading of the spool at position 24, the spool is moved to the impregnating position. Each of the end members 18 include radially expandable sealing members 30 preferably in the form of elastomeric rings, also described in detail in the above-referenced pending patent applications. The sealing rings are preferably formed of a deformable elastomeric material, such as vulcanized rubber, and are arranged to receive a hydraulic fluid via fluid lines 32. Hydraulic fluid, such as food grade oil is forced through the lines 32 by a hydraulic accumulator 34. The hydraulic fluid is forced into one end of the spool via a bore through a connecting rod 36 partially illustrated in FIG. 1 connected to at least one end of spool assembly 16. The hydraulic fluid is forced against the interior of the sealing rings 30 causing them to expand radially outwardly and seal the pressure chamber 22 against leaks.

High pressure fluid supply/recycle line 38, and recovery line 40 communicate through the shell 14 via a plurality of ports 42. These ports which may be circumferentially distributed about the periphery of the shell 14 allow the introduction and removal of high pressure fluid into and out of the impregnation zone 22 defined by the spool end member 18 and the cylindrical shell 14. An exterior manifold 44 surrounds the ports 42 and directs the fluid expansion agent into the shell 14 via the circumferential ports 42. The high pressure expansion flows through the ports 42 and then into the tobacco loaded and compressed about the spool connecting rod 20 via a plurality of ports and channels in the spool body as described in the above-referenced pending applications. A pair of fast acting valves 46 and 48 are provided for rapid introduction and release of fluid into and out of the impregnating chamber 22. These valves can be ball valves having a port size ranging from 0.5 inch to 1.5 inch in diameter or greater depending on the size of the impregnation zone 22 to thereby provide for substantially instantaneous admittance and removal of high pressure fluid to and from the impregnation zone 22. The valves are advantageously automatically opened and closed by fast acting hydraulic actuators, not shown.

An expansion agent recovery line 40 is provided to further remove propane that remains in the impregnation zone and is not recycled due to equalization of pressures in the accumulator and chamber. It also provides for periodic removal of high pressure expansion agent from the impregnation zone 22 so that contaminants including moisture, etc., do not build up to undesirable levels in the expansion agent. Line 40 is connected to an optional gas recovery or disposal zone (not shown) for recovery of expansion agent or recovery of energy therefrom. Also on the unloading side, pneumatic unloading nozzles 41 supplied from an oil free compressor can be provided in the tobacco unloading zone. The unloading nozzles can direct fluid such as high pressure air or nitrogen onto the tobacco surrounding spool assembly 16 when the spool is moved to and from the unloading position 26. Tobacco removed in unloading position 26 can then be fed to a recovery chute wherein the tobacco can be further treated by drying to stabilize expansion or heated to effect or increase expansion, depending on the expansion agent, temperature conditions, moisture in the tobacco, etc.

On the expansion agent input side, the high pressure gas line 38 is connected to a variable volume positive displacement accumulator device 50 discussed in greater detail below with regard to FIG. 2. A vaporizer 52 or other heating device is advantageously provided upstream of the positive displacement accumulator 50 for heating fluid expansion agent, preferably propane, fed to the accumulator 50 from an expansion agent supply zone 54. Accumulator 50 may also be heated by any of various heating elements such as a heating jacket or the like (not shown) in order to maintain the fluid expansion agent within the accumulator in a heated condition. A plurality of high pressure pumps 56 are located at the expansion agent supply side of vaporizer 52 for feeding high pressure fluid at elevated pressures, i.e., for propane up to about 600 psig, to vaporizer 52 and accumulator 50. Although only a single pump 18 is illustrated, typically two or more than two pumps can be used as needed to increase pressure of the fluid fed from the supply 54 up to the desired pressure range.

A fast acting valve 60 is provided in supply line 38 between vaporizer 52 and the accumulator 50. The valve is also advantageously automatically opened and closed by fast acting hydraulic actuators, not shown.

Figure 2:
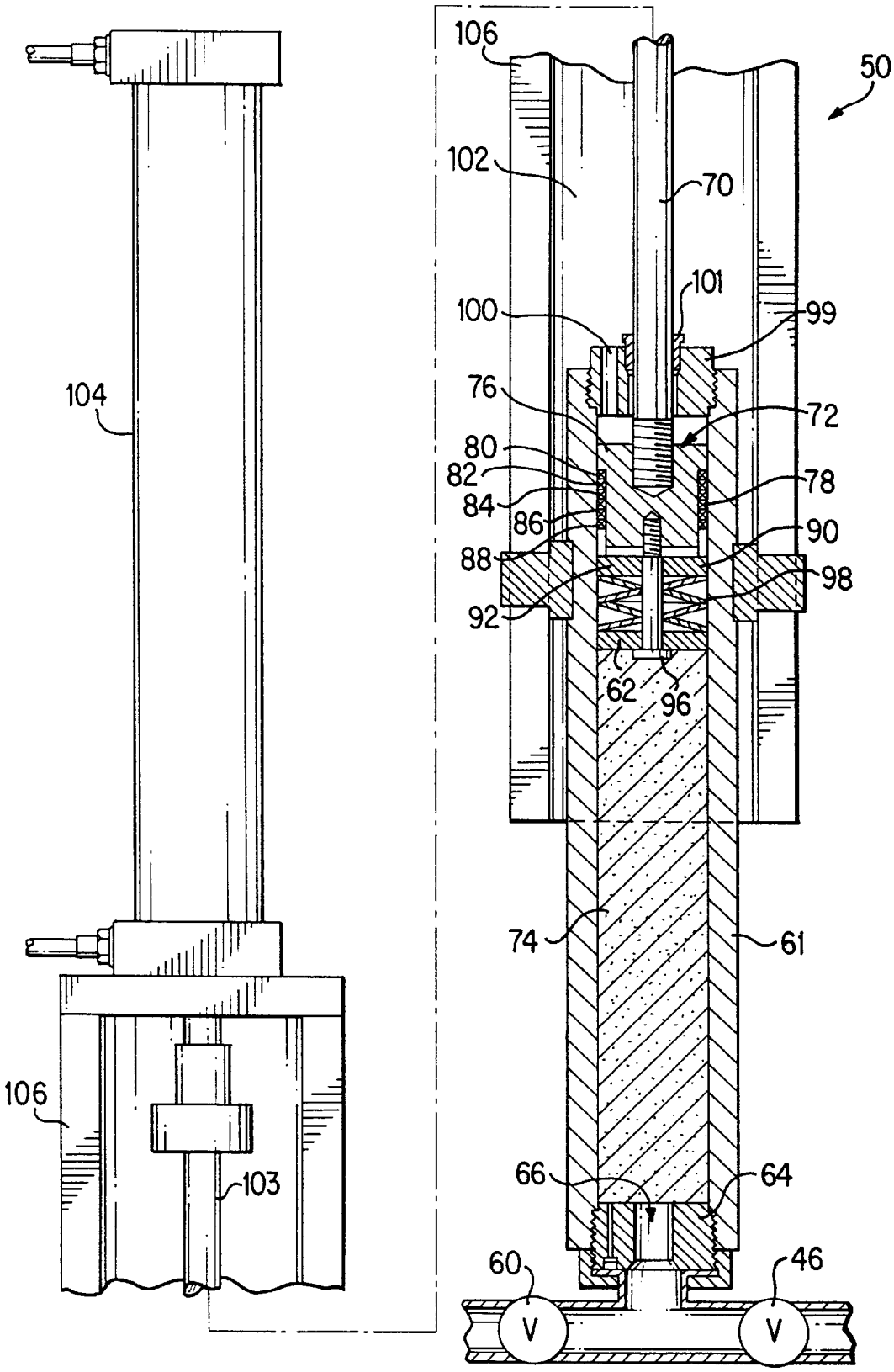
FIG. 2 is a cross-sectional view of a preferred accumulator for use in the apparatus illustrated in FIG. 1, which is capable of substantially instantaneous introduction of fluids having temperatures and pressures above the supercritical temperatures and pressures thereof into the apparatus of FIG. 1.

FIG. 2 is a cross-sectional view of a preferred positive displacement piston discharge accumulator 50 which is capable of accumulating a batch of a compressible expansion agent at a first pressure and forcibly discharging the expansion agent while compressing and simultaneously increasing the temperature of the expansion agent. The accumulator 50 is used to provide a high pressure, high temperature fluid expansion agent, such as propane at elevated pressures up to and exceeding 2500 psig, and at elevated temperatures up to and exceeding about 200° F., to the impregnation zone in the spool impregnator shown in FIG. 1.

The accumulator 50 includes body portion formed by a tubular shell 61 defining a cylindrical vessel. The shell 61 is formed of a material capable of withstanding high temperatures and pressures, such as high grade carbon steel which has been hardened on its inside surface. At one end of the vessel defined by the shell 61, there is a moveable end member 62 which defines a dynamic fluid seal and at the other end of the cylindrical vessel is an end member 64 having a port 66 for admitting and discharging the expansion agent. The end member 62 is connected to an axially movable shaft 70 which cooperates with the end member 62 to form a positive displacement piston or plunger 72 mounted for movement within the cylinder 60. The piston 72 is thus capable of changing the volume of fluid zone 74 by positively displacing all or a portion of the interior volume thereof. As the plunger 72 is moved in a direction toward port 66, it compresses fluid within zone 74 while simultaneously discharging all or a portion of the fluid through port 66.

The piston or plunger head 76 is prepared from a suitable material such as phosphor bronze. A cylindrical dynamic sealing member 78 is provided about the exterior periphery of the plunger head 76. The sealing member 78 is capable of providing and maintaining a seal between the interior surface of the cylinder 60 and the circumferential exterior of the plunger head 76 during axial movement of the plunger 72. The sealing member is preferably inert, flexible, and formed of a relatively low friction material.

An exemplary sealing member 78 capable of maintaining a seal at pressures exceeding 2500 psig and temperatures exceeding 200° F. is illustrated in FIG. 2 as five separate carbon packing rings 80–88 surrounding the periphery of the plunger head 76 and providing for sealing contact between the exterior periphery of the plunger head 76 and the interior of the shell 61. The three axially interior packing rings 82, 84 and 86 are advantageously more flexible or deformable than the axially exterior packing rings 80 and 88. These packing rings are molded from any of various high temperature stable carbon based sealing ring materials such as GRAFOIL carbon and are commercially available. As will be apparent, other materials which are inert and capable of providing a seal between plunger head 76 and the interior of shell 61 during movement of plunger 72 can also be used.

The packing rings 80–88 are maintained under axial compression by an annular ring member 90 which is forced axially against the rings by the ears 92 of an annular forcing member 94. The forcing member 94 is secured to the piston member 72 by a threaded bolt 96 and applies a predetermined biasing force due to biasing members 98 which are commercially available spring washers. The compression force supplied via bolt 96, compressions member 94 and annular ring 90 to the packing rings 80–88 is typically sufficient to partially flatten the springs washers 98. The resultant axial force applied to the packing rings 80–88 causes the rings to expand in the radially outward direction and thereby form a seal between the exterior periphery of the sliding plunger head 76 and the interior periphery of the shell 61.

A shaft support member 99 having an axial bore carrying a bushing 101 is mounted at an exterior end of the shell 61 to support shaft 70. The shaft support member includes at least one port 100 to allow pressure equalization within the cylinder 60 on the rod side 102 thereof. A hydraulic cylinder or similar motor means 104 is coupled to shaft 70 via connecting rod 103 for moving the plunger 72 within the accumulator 50. Hydraulic cylinder 104 can be any of the types of hydraulic cylinder known in the art for converting hydraulic power into mechanical work. The connecting rod 103, is preferably disposed within a shell body 106 which collects any expansion agent leaking from chamber 74.

In FIG. 2, the hydraulic cylinder is shown in a fully retracted position with the result that plunger 72 within accumulator 50 is also retracted, allowing a full charge of expansion agent to be retained in accumulator 50. Although not shown in FIG. 2, the accumulator can include a heating jacket about at least a portion of the outer periphery of cylinder 60. The heating jacket can be any of the types of devices known in the art for heating fluid and/or maintaining the temperature of a fluid a vessel including tubular heat exchange elements and the like. As will be appreciated by the skilled artisan, the heating jacket can also extend the entire length of the accumulator cylinder. The accumulator volume can be changed by adjusting a mechanical stop (not shown) on the hydraulic cylinder, limiting retraction of the hydraulic cylinder, and thus the accumulator piston.

Returning to FIG. 1, in operation, high pressure pumps 56 and 58 are used to supply expansion agent to accumulator 50 at a pressure below the desired impregnation pressure for impregnation of tobacco with the expansion agent in impregnation zone 22. The expansion agent is discharged from the pumps 56 and 58 to a vaporizer 52. As the expansion agent passes through vaporizer 52, the expansion agent is preheated to an elevated temperature which is preferably below the desired impregnation temperature in impregnation zone 22. Preferably, the pressure of the expansion agent fed to the accumulator 50 is substantially less than the desired impregnation pressure, i.e., less than about 75% of the desired impregnation pressure; more preferably less than about 50% of the desired impregnation pressure, even more preferably less than about 33% of the desired impregnation pressure. This allows substantial pressurization of the expansion agent in the presence of the tobacco thereby generating heat for heating both the expansion agent and the tobacco charge.

Valve 60 is maintained in an open configuration as the expansion agent is introduced into accumulator 50. Similarly, valve 46 is maintained in a closed configuration so that expansion agent enters through port 66 into the interior 74 of accumulator 50. The pressure of the propane is used to retract the piston 72 to avoid drawing air into the accumulator.

After the propane pressure reaches the set point pressure of pump 56 as determined by a sensor associated with the pump or a sensor (not shown) associated with the accumulator 50, valve 60 is closed.

Valve 46 is then opened, and piston 72 is moved downwardly under force to thereby discharge the expansion agent from the accumulator into the high pressure gas line 38 and the impregnation chamber. Accumulator 50, line 38, and impregnation zone 22 are sized so that the total volume of line 38 and impregnation zone 22, when added together, is advantageously significantly less than the volume of the accumulator 50. Thus as the expansion agent is discharged from the accumulator 50 to the impregnation zone of FIG. 1, its volume is significantly reduced and the pressure and temperature thereof is significantly increased, e.g. to levels approaching and above the supercritical temperature and pressure of the expansion agent in preferred embodiments of the invention. Specifically, as the expansion agent is directed from the accumulator 50 through line 38 and into the impregnation chamber, the expansion agent is significantly compressed because of the force exerted by piston 72 in discharging the expansion agent into the decreased volume of the high pressure gas line 38 and the impregnation chamber 22. As the expansion agent is compressed, its pressure and temperature are increased, e.g., for propane from about 600 psig to about 2500 psig and from an initial temperature in the range of about 125° to 175° F. to a final temperature in the range of about 200° to about 275° F. The heat of compression produced as the expansion agent is compressed decreases the quantity of pre-compression and preheating needed for the expansion agent, and also the amount of preheating needed for the tobacco.

The exact construction of the accumulator and line 38 can vary depending upon various factors, such as the type of expansion agent used, the desired impregnation temperature and pressure of the agent, and the like, so long as the volume of the accumulator and line 38 is selected so as to increase pressure and temperature of the particular expansion agent to supercritical levels. In a preferred embodiment of the invention, using propane as the expansion agent, the accumulator can have a volume of at least about 150% more, preferably at least about 200% that of line 38 and the impregnation chamber, so that the hydraulic cylinder moves from about 1.5 to about 5 or more chamber volumes of expansion agent into the tobacco expansion chamber.

Thus the apparatus of the invention can provide economies of processing, for example, allowing use of an accumulator which can maintain an expansion agent at lower pressures and temperatures, as compared to prior accumulator apparatus. For example, in prior accumulator constructions, expansion fluid such as propane has been maintained in the accumulator at or above supercritical conditions, i.e., a pressure of about 3000 psig and a temperature above about 300° F. In contrast, in the present invention, propane can be maintained in the accumulator at a pressure of about 600 psig and a temperature of about 100° F. up to 175° F. depending on the degree of tobacco preheating, while providing equivalent impregnation conditions.

When the expansion agent has been discharged from the accumulator, valve 46 closes and the chamber pressure of the spool is held for the impregnation period. Preferably discharge of the expansion agent will essentially empty the accumulator. During impregnation, valve 46 is closed. Following a predetermined impregnation period, which may only be one to several seconds with high pressure, high temperature propane, valve 46 is opened to release propane from impregnation zone 22 to the accumulator for recycling. Valve 48 is then opened for final decompression or alternatively for total release of propane to recovery. The spool 16 is then moved to the unloading position to allow removal of the expanded or impregnated tobacco from the spool. A sensor detects when the pressure between the impregnation zone and the accumulator has reached equilibration and the valve 46 is then closed.

As will be appreciated by the skilled artisan, the amount of expansion agent redirected back to accumulator 50 will be less than the total amount of expansion agent originally charged to the impregnation zone because some expansion agent is absorbed by the tobacco and some of the expansion agent remains in the impregnation zone after reaching equilibration pressure. Thus the pressure of the expansion agent within accumulator 50 will be less than the pressure of the original charge, e.g. if the original pressure of the expansion agent in the accumulator was 600 psig, the pressure will be less than 600 psig. Generally, for propane, about two-thirds or more of the propane from the tobacco spool can be recycled back to the accumulator 50, and in the case of an initial propane pressure of 600 psig, the recycled propane can have a pressure of approximately 475 psig.

Thereafter, additional virgin or recovered propane from expansion agent source 54 can be introduced into accumulator 50. A sensor detects that the pressure within the accumulator is less than the desired charge pressure. Valve 48 is closed, valve 60 is opened, and a control activates the pumps which immediately start refilling the accumulator with high pressure fluid, i.e., propane. The accumulator 50 can be refilled in a short period of time, for example, from about 5 to 10 seconds, during the period employed in the present invention for impregnating the tobacco in impregnation zone 22 of FIG. 1. The propane is directed to accumulator 50 through valve 60 and port 66 to provide propane within the accumulator at a starting pressure of about 600 psig. When chamber pressure reaches the predetermined pressure conditions, i.e., about 600 psig, valve 60 closes.

As previously noted, propane pressure within the accumulator is used to retract the plunger 72 while hydraulic pressure is used to extend the plunger. This will minimize the possibility of ingestion of air into the accumulator device.

After release of propane from impregnation chamber 22, the pressure of the chamber 22 is advantageously monitored. When the pressure in the impregnation zone reaches equilization pressure, approximately 475 psig, valve 46 can be closed and valve 48 opened to direct the remaining propane to a propane disposal or recovery zone. Additionally, it is desirable to periodically release all or a substantial portion of propane or other expansion agent in impregnation chamber through valve 48 for disposal or recovery without recycling to accumulator 50 to prevent excess buildup of moisture and other contaminants in the propane or other expansion agent.

Figure 3:
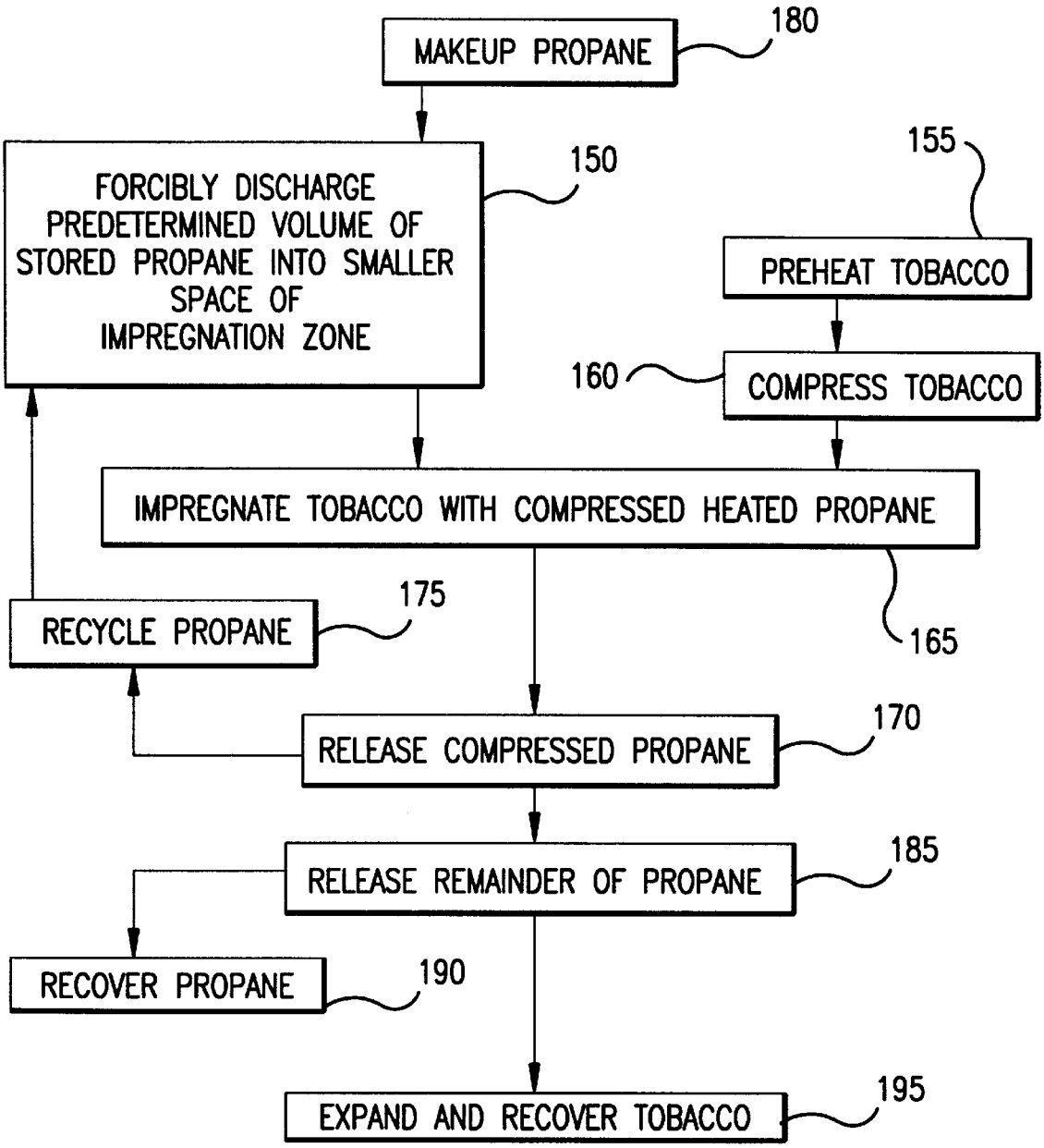
FIG. 3 illustrates a preferred process employing various aspects of the invention.

FIG. 3 illustrates a flow diagram of one preferred process of the invention. Preferably the process of FIG. 3 is conducted in accordance with U.S. Pat. No. 4,531,529 issued Jul. 30, 1985 to White and Conrad, and pending U.S. patent application Ser. No. 08/076,535 of Conrad and White, filed Jun. 14, 1993, and pending U.S. patent application Ser. No. 08/163,048 of Beard et al., filed Dec. 6, 1993, referenced above.

With reference to FIG. 3, the positive displacement accumulator of FIG. 1 is provided as shown in Block 150. As indicated in Block 155, tobacco preferably in the form of cut filler is advantageously preheated prior to introduction into the impregnation zone. Preheating of the tobacco also provides heat for establishing proper short cycle time conditions in the impregnation zone. Preferably, the tobacco is preheated to a temperature above about 125° F., more preferably a temperature of about 140° F. or greater e.g., to a temperature of 150°–160° F. or higher. Extra moisture is advantageously added to the tobacco to increase the pliability of the tobacco prior to and/or during preheating. Moisture contents between about 16%, up to about 30% or more, are advantageously used in the invention.

Preheating of the tobacco can be conducted by any of various means including the use of heated drums, microwave energy and steam injection. Steam heating is believed to be preferable because heat is more effectively transferred to the tobacco, while at the same time the moisture level can be increased.

The preheated tobacco can thereafter be compressed as indicated in Block 160 into an impregnation vessel such as the spool and shell assembly of FIG. 1 or into a high pressure stable sealable vessel of any of other conventional designs as will be apparent. Tobacco is preferably compressed at a compression ratio of at least about 1.25:1, more preferably above 1.5:1. Advantageously, the tobacco is compressed to a compression ratio of greater than 2:1, up to ratios amounts of 3:1 and greater based on the original loose fill density of the tobacco. Compression of the tobacco increases the tobacco density so that the density of the tobacco fed into the impregnation zone is substantially greater than the tobacco density prior to compression which substantially improves use of the space within the impregnator. Those skilled in the art will be aware that loose fill tobacco densities can vary greatly depending on factors including whether the tobacco is in leaf form or in cut filler form, the type of tobacco, the moisture content of the tobacco, and other factors. Packing densities of 20 pounds per cubic foot, calculated based on a moisture content of 12% are readily employed in the present invention. Although increasing the packing density may, to some extent, increase the cycle time for achieving identical amounts of expansion, packing densities in excess of 25–30 pounds per cubic foot calculated based on 12% moisture and higher have also been successfully used in the present invention while achieving impregnation times of below 20 seconds and filling capacity increases in excess of 50–100%.

The compressed tobacco is thereafter impregnated in the impregnation zone as indicated in Block 165. When propane is used as the impregnating fluid, the cumulative amount of heat supplied to the impregnation zone from the heated propane and the preheated tobacco is advantageously sufficient to provide impregnation conditions in the impregnation zone of between about 240° F. and about 270° F., preferably about 260° F. It has been found that impregnation at temperature and pressure conditions of about 260° F. and 2,500 psig can be achieved in about 5 seconds or even less when the heat is supplied by both the preheated tobacco and preheated propane.

As discussed above, each of the accumulator 50, high pressure fluid supply line 38 for introducing the propane from the accumulator to the chamber, and the chamber 22 is sized so that as the expansion fluid is forcibly discharged from the accumulator by action of the plunger 72, and then enters into line 38 and impregnation chamber 22, the expansion agent is heated and pressurized to a desired tobacco impregnation pressure, which is preferably a pressure near or above supercritical pressure and a temperature above about 200° F.

It will be apparent that the degree of propane or other expansion agent compression can be varied to vary the amount of heating of the expansion agent due to compression. Advantageously the amount of heat added to the propane by compression is balanced with the amount of heat desired to be added to both the propane and tobacco. Thus, when the propane fluid is heated to higher temperatures, the tobacco can be heated to a lesser degree to provide the desirable temperature conditions in the impregnation zone. However, there is believed to be an upper limit of temperature for the propane above which the tobacco in the impregnation zone might be harmed. In addition, because low volumes of impregnation fluids are used in preferred embodiments of the present invention, the mass of the impregnation fluid available for heating of the tobacco is relatively low and thus there is a limit to the amount of heat that can be added to the tobacco. The volume of the accumulator is therefore preferably at least twice the combined volume of the impregnation chamber and supply line. The addition of heat from a source such as the tobacco is desirable.

It will also be apparent that heating of materials in the tobacco impregnation zone can be supplemented by other means, such as by employing a heater in the impregnation zone. However, for extremely short cycle times, the combination of preheated tobacco and preheated high pressure propane which is compressed for additional heating and is believed to produce extremely desirable results.

The compressed and impregnated tobacco is maintained under impregnation conditions for a short period of time ranging from 1–2 seconds up to about twenty seconds. As shown in Block 170 of FIG. 3, thereafter the pressure is released. Preferably, pressure release is substantially instantaneous, i.e., is achieved in about one second or less. This can be achieved by employing fast acting valves having large ports for rapidly releasing pressure. The compressed tobacco is then substantially immediately removed from the impregnation zone so that expansion of the tobacco can be effected. Preferably, the tobacco is treated by contact with forced dry air or heated air in order to establish a moisture content of, for example, about 10–12% moisture which helps stabilize the tobacco in expanded form.

When the expansion agent is propane or a similar expansion agent of the type disclosed in U.S. Pat. No. 4,531,529 to the White and Conrad, no heating of the tobacco is necessary in order to fix the tobacco in expanded form. Moreover, there is no substantial loss of volatile flavoring agents, sugars or the like, because of the lack of high temperature heating conditions. However, the invention can also be employed in connection with other expansion agents including those which require the use of expansion conditions including heat in order to achieve or fix expansion of the tobacco.

As indicated in Block 175, propane is directed or recycled back to the accumulator for use in subsequent tobacco treatment cycles. The pressure of propane within the accumulator after one cycle will be less than the starting pressure, e.g., about 475 psig. Thereafter as indicated at Block 180, the accumulator is then refilled with makeup propane to provide within the accumulator a starting pressure of about 600 psig. While the makeup propane is being added to the accumulator 50, the remaining propane is released from impregnation zone 22 as shown in Block 185. The remaining propane is then recovered or passed to disposal as shown in Block 190. The impregnated tobacco is then expanded as shown in Block 195 as the spool 16 is moved to unloading zone 26.

Figure 4:
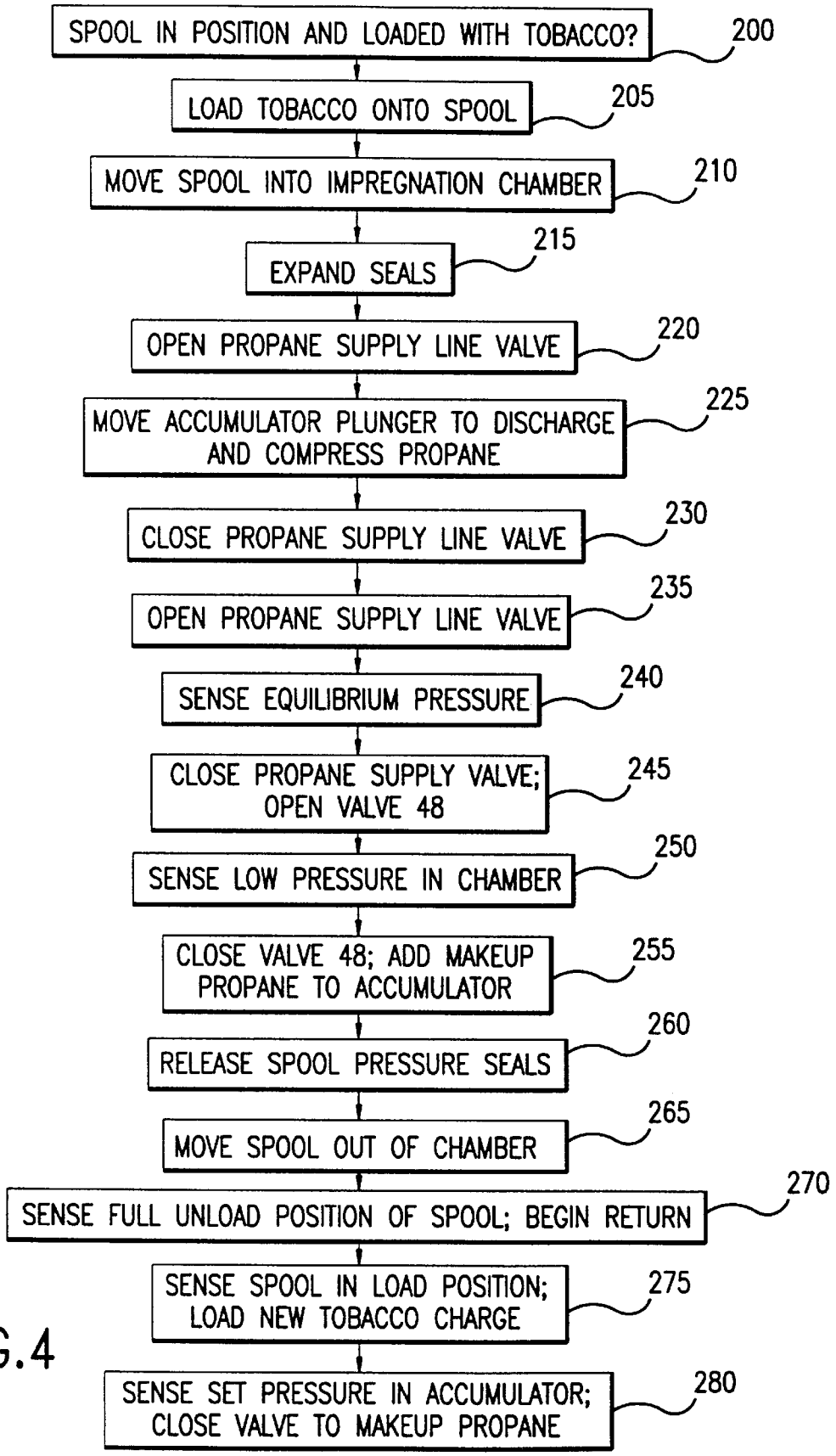
FIG. 4 schematically illustrates a preferred control method for operating the apparatus illustrated in FIG. 1.

FIG. 4 illustrates one preferred control method used in connection with the apparatus of FIG. 1 to achieve expansion of tobacco. This or a similar control system including sensors for sensing conditions during the expansion process are extremely desirable in order to achieve desired short cycle times, i.e., of twenty seconds or less. Control hardware can be pneumatic, electric or pneumatic and electric based and can include a microprocessor as will be apparent to those skilled in the art.

With reference to FIG. 4, in Block 200 appropriate sensors are used to verify that the spool is in the loading position 24 and that an appropriately sized charge of tobacco is in position for loading. If these conditions are satisfied, control passes to Block 205 and tobacco is loaded onto the spool assembly 16. An appropriate sensing mechanism senses loading of tobacco, and control is then passed to Block 210. In Block 210, the hydraulic piston 28 is activated to move the spool into the pressure shell 14. An appropriate sensor such as a proof of position switch or the like senses the position of the spool in the proper location in shell 14 and control is then passed to Block 215.

In Block 215, a valve is opened to allow hydraulic fluid from hydraulic accumulator 34 to force the seals 30 radially outwardly into contact with shell 14. The hydraulic accumulator 34 preferably holds sufficient amount of hydraulic fluid to pressurize each of seals 30 to a pressure of 3,000 psi during a time period of about one second or less, preferably substantially less than one second. An appropriate sensor senses the fluid pressure of fluid within the seals 30 and when the pressure is at the desired pressure, for example, 3,000 psi, control is passed to Block 220.

In Block 220, an appropriate sensor verifies that valve 60 between propane supply 54 and accumulator 50 is closed and the control then opens the fast acting fill valve 46. Control then passes to block 225 in which the hydraulic actuator extends plunger 72. This discharges the expansion agent, such as propane which has been maintained in the accumulator 50 at a pressure and temperature below that desired for tobacco impregnation, e.g., a pressure about 600 psig and a temperature of about 200° F. The expansion agent is then compressed, and thus heated, as it enters into the impregnation zone 22, e.g, to a temperature above 200° F. and a pressure of about 2500 psig.

Control then passes to Block 230 wherein valve 46 is then closed. Under the above conditions, and particularly when the tobacco in the impregnation zone has been preheated, the impregnation is quite rapid, and can be for a short period of between several seconds and about 15–20 seconds. A timer can be activated for this period of time. The timing for impregnation can be adjusted based on moisture conditions, temperature conditions and density conditions of the tobacco in the impregnation zone 22. When the timer reaches the set time period, valve 46 is once again opened as shown in Block 235. Propane then returns from the impregnation zone back into accumulator 50 causing piston 72 to retract. As noted above, the pressure of the propane redirected back into accumulator 50 will be less than the desired charge pressure, i.e., about 475 psig versus 600 psig.

Control then passes to Block 240 and a pressure sensor within the impregnation zone is compared with a pressure sensor in the accumulator until the two pressures have equilibrated. Control then passes to Block 245 wherein propane supply valve is closed and valve 48 is then opened to allow the remaining propane to flow to a recovery zone. Control then passes to Block 250 wherein a pressure sensor in the impregnation zone 22 is repeatedly read until the pressure in the impregnation zone has dropped to a predetermined low pressure, for example, less than 5 psig.

At this point, control is passed to Block 255 for rapid closing of valve 48 and rapid opening of the propane supply valve 60 allowing the entry of makeup propane into accumulator 50. Control is then passed to Block 260 wherein a valve is opened to allow hydraulic fluid to be removed from seals 30 on the spool. An appropriate sensor senses the pressure of the hydraulic fluid in the seals and when the fluid pressure has reached a desirably low pressure, control is passed to Block 265.

In Block 265, the spool actuator, i.e., hydraulic piston 28, is activated to move the spool assembly 16 to the unloading position 26. At the same time, a compressor is started for directing high pressure air or nitrogen onto the spool as it is moved into position 26. In Block 270 an appropriate sensor senses the position of the spool when it reaches the fully extended unloading position and the hydraulic piston 28 then immediately changes the direction of motion of the spool for return to the loading position 24. Control is next passed to Block 275 wherein a sensor detects the position of the spool in the load position 24 and a new charge of tobacco is then loaded onto the spool.

Control is then passed to Block 280, wherein a sensor verifies that the pressure within accumulator is within the desired charge pressure range, e.g., 600 psig. A control deactivates the pumps 56 and 58 and valve 60 is then closed. The control sequence is then started again beginning with Block 200.

The various aspects of the tobacco expansion processes described herein have been discussed specifically in connection with the use of propane as an expansion promoting impregnation agent and the use of impregnation temperature conditions near or above supercritical temperature together with conditions of elevated pressure approaching or above supercritical pressure, and in connection with preferred apparatus. However, various significant tobacco expansion processes and apparatus disclosed herein are also considered applicable to other tobacco expansion processes, expansion fluids, and apparatus. For example, rapid expansion agent compression with simultaneous heat generation can substantially improve the throughput of many tobacco impregnation processes conducted in various vessels at high pressures of, e.g., above 100 psig, for subsequent tobacco expansion.

Similarly, the rapid introduction into the impregnation zone of high temperature, high pressure impregnating fluids, such as carbon dioxide, with simultaneous compression and heating, can be used to provide heat to both the expansion agent and to the tobacco to significantly shorten the impregnation time period necessary prior to a subsequent heating step.

The invention has been described in considerable detail with reference to preferred embodiments. However many changes, variations, and modifications can be made without departing from the spirit and scope of the invention as described in the foregoing specification and defined in the appended claims.

That which is claimed is:

1. An apparatus for impregnating tobacco with an expansion agent, comprising:

an impregnation chamber of predetermined volume for impregnating a batch of tobacco with an expansion agent under elevated pressure conditions;

a fluid supply line of predetermined volume communicating with said impregnation chamber;

an accumulator containing a compressible expansion agent at a first temperature and pressure, said accumulator comprising a discharge piston adapted to forcibly discharge a first volume of said expansion agent, measured at said first pressure and temperature, from said accumulator into said fluid supply line and said impregnation chamber;

wherein the combined volume of said supply line and said impregnation chamber is less than said first volume of expansion agent whereby the pressure and temperature of said expansion agent are increased above said first pressure and temperature as said expansion agent is supplied to said impregnation chamber confining said tobacco batch.

2. The apparatus according to claim 1, wherein said first pressure and temperature of said expansion agent is a temperature of at least about 100° F. and a pressure of at least about 500 psig.

3. The apparatus according to claim 2, wherein said pressure and temperature of said expansion agent are increased above about 2000 psig and about 200° F. as said expansion agent is supplied to said impregnation chamber confining said tobacco batch.

4. The apparatus according to claim 1, wherein the volumes of said impregnation chamber, said accumulator, and said fluid supply line are selected so that the pressure and temperature of said expansion agent discharged from said accumulator into said fluid supply line and impregnation chamber is increased to a temperature and pressure including a pressure approaching or above the supercritical pressure thereof.

5. The apparatus according to claim 4, wherein the volume of said accumulator is at least about 50 percent greater than the total volume of said impregnation chamber and said fluid supply line.

6. The apparatus according to claim 1, wherein said accumulator comprises a positive displacement plunger mounted for movement within the interior thereof.

7. The apparatus according to claim 6, wherein said accumulator is provided in the form of a cylindrical vessel.

8. The apparatus according to claim 7, wherein said plunger in said cylindrical accumulator vessel is adapted to displace substantially all of the expansion agent out of said accumulator vessel in a single stroke.

9. The apparatus according to claim 6, wherein said plunger is coupled to a hydraulic actuator.

10. The apparatus according to claim 1, further comprising an expansion agent supply fluidly connected to said accumulator comprising a supply of said expansion agent at a predetermined storage pressure.

11. The apparatus according to claim 10 further comprising at least one pump for transporting said expansion agent from said supply to said accumulator and for increasing the pressure thereof.

12. The apparatus according to claim 11, further comprising a heater positioned between said supply and said accumulator for heating expansion agent transported to said accumulator from said supply by said pump.

13. The apparatus according to claim 10, further comprising;

a first valve arranged to fluidly connect and disconnect said accumulator with said impregnation chamber;

a second valve arranged to fluidly connect and disconnect said accumulator with said expansion agent supply; and a control associated with said first and second valves for sequentially closing said second valve to disconnect said accumulator and said expansion agent supply, opening said first valve to admit expansion agent into said impregnation chamber, closing said first valve while a tobacco batch in said expansion chamber is impregnated, and then opening said first valve while said second valve is maintained in the closed position to recover expansion agent from said chamber to said accumulator after impregnation of tobacco.

14. The apparatus according to claim 13, further comprising an expansion agent recovery line fluidly connected to said impregnation chamber for recovering expansion agent from said chamber.

15. A process for expanding tobacco, comprising the steps of:

loading a tobacco charge into an impregnation zone of predetermined volume;

forcibly discharging from an accumulator containing a compressible expansion agent at a first temperature and pressure, a predetermined volume of said expansion agent, measured at the first pressure and temperature, said predetermined volume being greater than the volume of said impregnation zone; and introducing said predetermined volume of said expansion agent into the lesser volume of said tobacco impregnation zone to thereby increase the pressure and temperature of expansion agent above the first pressure and temperature.

16. The process according to claim 15, further comprising the steps of:

impregnating said tobacco in said impregnation zone with said expansion agent; and removing impregnated tobacco from said zone and subjecting the impregnated tobacco to conditions sufficient to expand the tobacco.

17. The process according to claim 15, wherein said loading step comprises substantially filling the available impregnation volume of said impregnation chamber with tobacco compressed at a compression ratio of at least 1.5:1 relative to the loose fill volume of said tobacco.

18. The process according to claim 15, wherein said expansion agent is propane.

19. The process according to claim 18, wherein said first temperature and pressure of said propane in said accumulator comprise a temperature of above about 125° F. and a pressure above about 500 psig.

20. The process according to claim 19, wherein said introducing step comprises introducing said propane fluid into said impregnation zone under conditions such that the pressure of said propane is increased to a pressure above about 2000 psig and the temperature of said propane is increased to a temperature above about 200° F.

21. The process according to claim 15, comprising the step of preheating said tobacco charge prior to loading said tobacco charge into said impregnation zone.

22. The process according to claim 16 further comprising the step of recycling expansion agent from said impregnation zone directly to said accumulator after the step of impregnating said tobacco charge in said impregnation zone.

23. The process according to claim 22, further comprising loading an additional tobacco charge into said impregnation zone;

repeating said expansion agent discharging, introducing and recycling steps;

loading at least one additional tobacco charge into said impregnation zone and repeating said impregnating steps at least one further cycle; and thereafter removing expansion agent from said impregnation zone and passing said expansion agent to a recovery or disposal zone.

* * * * *